US006773201B2

(12) United States Patent
Witcher

(10) Patent No.: US 6,773,201 B2
(45) Date of Patent: Aug. 10, 2004

(54) SOFT WALL FOR RACE TRACKS

(75) Inventor: David L. Witcher, Salisbury, NC (US)

(73) Assignee: Safety Systems, Inc., Salisbury, NC (US)

( * ) Notice: Subject to any disclaimer, the term of this patent is extended or adjusted under 35 U.S.C. 154(b) by 62 days.

(21) Appl. No.: 10/278,925

(22) Filed: Oct. 24, 2002

(65) Prior Publication Data

US 2003/0095834 A1 May 22, 2003

Related U.S. Application Data

(60) Provisional application No. 60/331,629, filed on Nov. 20, 2001.

(51) Int. Cl.[7] ..... E01F 15/00
(52) U.S. Cl. ..... 404/6; 404/10
(58) Field of Search ..... 404/6, 10; 256/13.1

(56) References Cited

U.S. PATENT DOCUMENTS

| | | | | | |
|---|---|---|---|---|---|
| 4,635,981 | A | * | 1/1987 | Friton | 293/1 |
| 5,314,261 | A | | 5/1994 | Stephens | |
| 5,452,963 | A | * | 9/1995 | Christensen | 404/6 |
| 5,791,811 | A | * | 8/1998 | Yoshino | 404/6 |
| 6,010,275 | A | | 1/2000 | Fitch | |
| 6,276,667 | B1 | | 8/2001 | Arthur | |
| 6,439,801 | B1 | * | 8/2002 | Galiana et al. | 404/6 |
| 6,533,495 | B1 | * | 3/2003 | Williams et al. | 404/6 |
| 6,554,530 | B2 | * | 4/2003 | Moore | 404/6 |

FOREIGN PATENT DOCUMENTS

| | | | |
|---|---|---|---|
| JP | 5-202509 | * | 8/1993 |
| WO | 99/39054 | * | 8/1999 |

* cited by examiner

*Primary Examiner*—Gary S. Hartmann
(74) *Attorney, Agent, or Firm*—Richard C. Litman

(57) ABSTRACT

A modular energy absorbing soft wall system consisting of a plurality of partially overlapping interlocking panel structures slidably mounted on anchors on the side surface of an elongated concrete roadway barrier or median. Each panel consists of a flexible core layer sandwiched between an front and rear high density plastic layer. The core layer consists of a plurality of vertically extending air chambers. An elongated top piece with a flat bottom and an arched top is secured to the top portion of the core layer. The bottom portion of the system rests upon intermittent supports which extend to the road surface. During a vehicular impact energy is absorbed when the plastic layers deform, the chambers collapse, and the trapped air in the chambers escapes out apertures in the inner plastic layer and through the bottom of the rubber layer.

7 Claims, 7 Drawing Sheets

SOFT WALL FOR RACE TRACKS

CROSS-REFERENCE TO RELATED APPLICATION

This application claims the benefit of U.S. Provisional Patent Application Serial No. 60/331,629, filed Nov. 20, 2001.

BACKGROUND OF THE INVENTION

1. Field of the Invention

The present invention relates to energy absorbing systems, and particularly to a modular wall system which can be installed on existing concrete barrier walls in order to absorb the energy from a vehicular impact.

2. Description of Related Art

There are a number of injuries and fatalities every year due to collisions between vehicles and concrete barrier walls. This problem is especially prevalent in racing situations where drivers can reach speeds in excess of two hundred miles per hour and tracks are completely surrounded by concrete barrier walls. Concrete barriers walls are effective in keeping vehicles on the track, but impacts with these barriers can cause serious injuries or death to the drivers of the impacting vehicles due to the unyielding nature of concrete. Many of these injuries could be avoided if more impact energy was absorbed by the barrier wall rather than the occupants of the vehicle. It is therefore desirable to have an effective energy absorption system which is cost effective and easy to install on existing concrete barrier walls.

There have been a variety of systems proposed to reduce injuries to drivers when vehicles accidentally impact concrete barriers. One system is the PEDS barrier which employs high density polyethylene barrels connected to the concrete barriers with longitudinally spaced cables extending around the barrels. The barrels themselves are wrapped in a overlapping sheet of high density polyethylene material which is attached to the barrels by bolts. This system is effective in reducing injuries and absorbing energy but it is costly to install, difficult to repair and does not use air as an energy absorption means.

U.S. Pat. No. 6,276,667 discloses an energy dissipating system which is attachable to concrete barriers. This system consists of a horizontally extending flexible sheet of plastic secured to the barrier so as to form a cavity between the barrier and the plastic sheet. Inside this cavity is an elongated energy dissipating member extending horizontally within the cavity. This system is designed to reduce friction between vehicles and the barrier, but it is not designed to absorb the energy of a head-on collision at racing speeds. This system also does not have a slide-on, slide-off design, and does not use air as an energy absorption means.

U.S. Pat. No. 6,010,275 discloses an impact attenuating guard rail and includes a rail extending horizontally, a plurality of fixed support posts and a resilient, compressible, energy absorbing means mounted between the rail and the posts. This is an effective energy absorbing system but the guard rail does not use air as a means for dissipating crash energy, nor does it easily attach to an existing concrete barrier wall.

U.S. Pat. No. 5,314,261 discloses a vehicle crash cushion which includes an array of panels positioned to overlap one another and which is oriented parallel to a barrier adjacent to a roadway. Located between the panels and the barrier are elastomeric tubes which function to absorb energy when the panels are depressed toward the barrier. This system differs from the present invention in that it does not use air to dissipate crash energy. It also lacks a slidable connection to a concrete barrier wall for easy installation and repair, and it is not designed to reduce debris associated with impact. The elastomeric tubes are open at top and bottom so that they collapse readily against the barrier wall, whereas the present invention uses a unitary, enclosed core with restricted orifices venting to the atmosphere, so that considerably more force is required to compress the core of the present invention. The elastomeric tubes described in Stephens are bolted to each other, requiring considerable labor to assemble, and are secured to the concrete barrier by bolting only a single tube to the barrier. Further, the front panel is made from plywood wrapped by fiberglass, so that the plywood is prone to fracture on high speed impact. The front panel is secured to the concrete panel by a complex suspension cable structure, and apparently is not attached to the elastomeric tubes.

There is a need for an improved energy absorbing system, which is easier to install and replace, does not retain water after a rain storm which might otherwise cause a dangerous track condition, uses air as an energy absorbing means, and is designed to repeatedly absorb an impact and contribute little if any debris to the race track.

None of the above inventions and patents, taken either singly or in combination, is seen to describe the instant invention as claimed.

SUMMARY OF THE INVENTION

The soft wall for race tracks is an energy absorption system for absorbing vehicular impact energy in order to reduce injuries. The invention is a modular system having a plurality of laminated panel structures adapted for attachment to concrete barrier walls. The panel structures are slidably attached to brackets mounted to the concrete barrier wall. Each panel structure consists of an elongated, flat, front panel, a flexible core layer, and an elongated, flat, rear panel. The core layer resembles a wall and has a front, back, top, bottom, and left and right sides. The rear panel is flush with the back of the core layer, but the front panel is offset from the front of the core layer so that the adjacent structures overlap. The core layer is hollow and when viewed from above is shaped like a parallelogram. Vertically extending partition walls support the core layer internally and divide the core layer into a plurality of vertically extending parallelogram shaped chambers. Each chamber contains several apertures so that adjacent chambers are in fluid communication with each other and the atmosphere, thus allowing air in the chambers to escape to adjacent chambers or to the atmosphere when the chambers are compressed upon impact. The soft wall has several feet attached to the bottom of the core layer to assist in drainage.

Accordingly, it is a principal object of the invention to protect race car drivers from injury in crashes by reducing the rate of negative G's on the driver.

It is another object of the invention to provide an energy absorption system that can easily be affixed to or removed from a track wall.

It is a further object of the invention to provide an energy absorption system which will not retain water between itself and the track which could seep out later and provide a dangerous track condition.

Still another object of the invention is to provide an energy absorption system having impact resistant plastic panels to reduce the incidence of fracture when struck by a vehicle, thereby reducing accident debris which might otherwise delay a race with additional clean up time, while still providing a cushion for the barrier, and so that the integrity of the soft wall is not compromised by collision whereby the wall does not have to be replaced after every impact.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
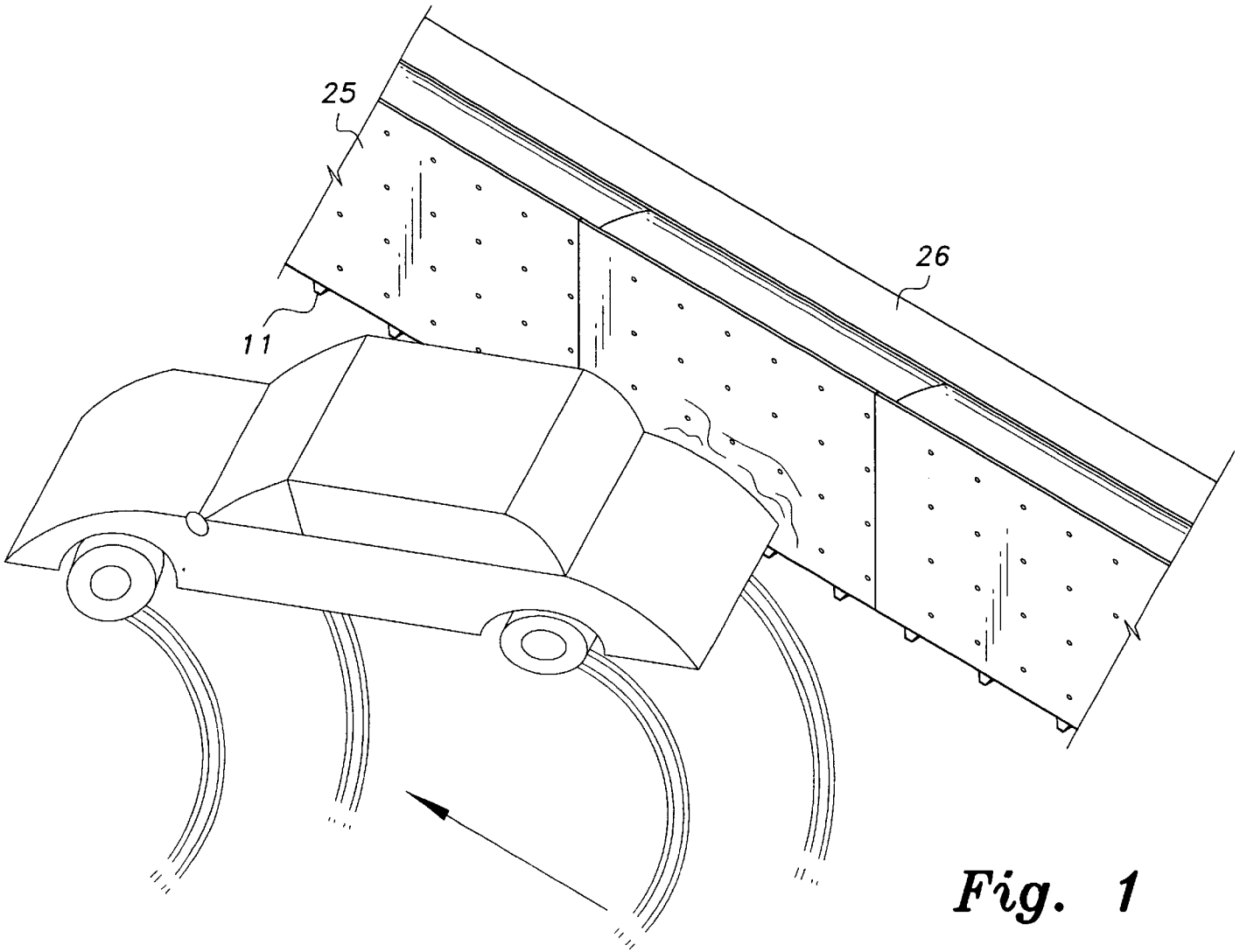
FIG. 1 is an environmental perspective view of a soft wall for race tracks according to the present invention.
Figure 2:
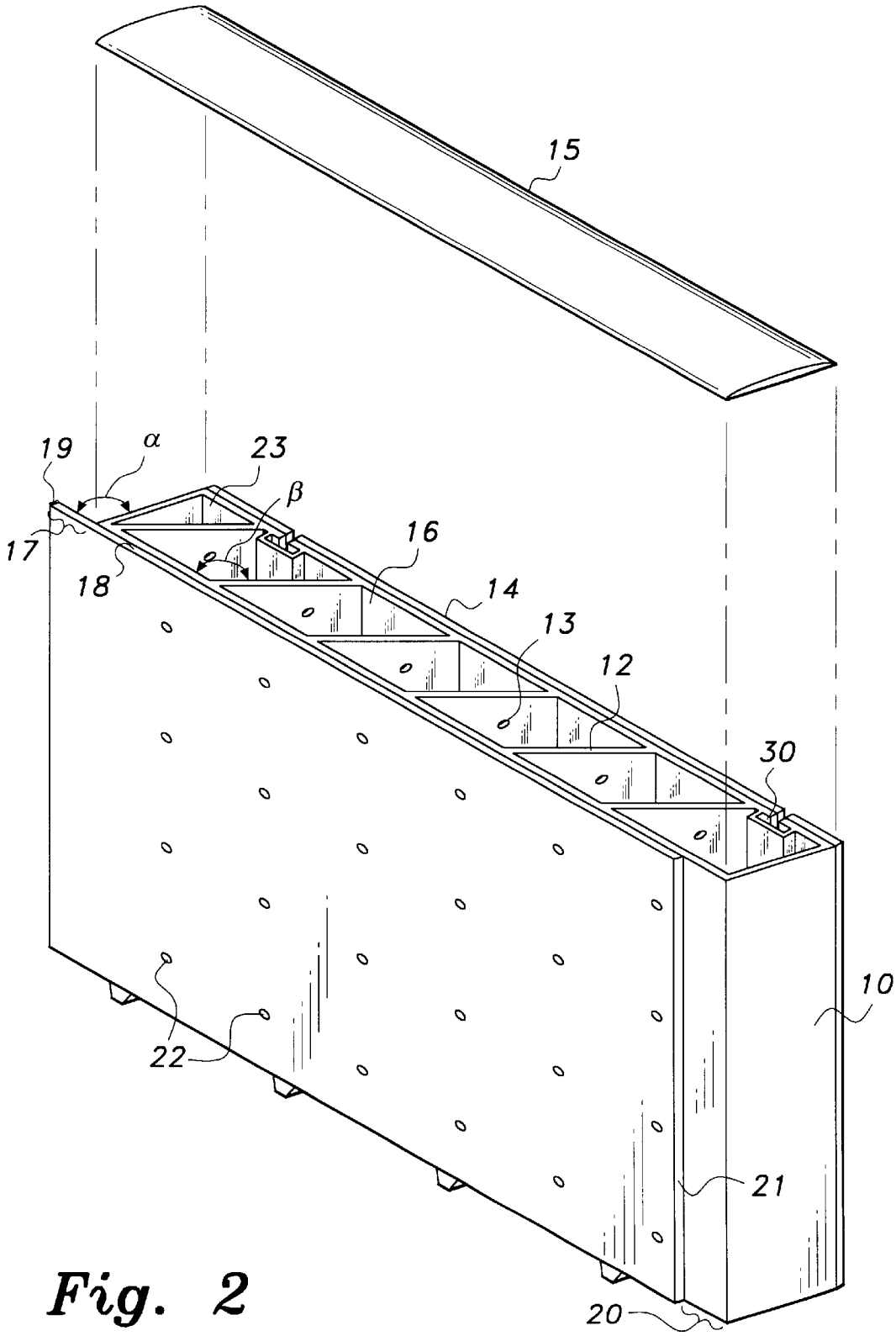
FIG. 2 is a perspective view of a soft wall panel structure with the top portion removed to show the inside of the soft wall.

FIGS. 1 and 2 show an overview of a preferred embodiment of the invention. The soft wall system is a plurality of panel structures 25 positioned to partially overlap and to interlock with one another while lying parallel to a concrete barrier wall 26 positioned adjacent to a race track as seen in FIG. 1. The panel structures are oriented in anticipation that traffic will travel in the direction of the arrow in FIG. 1 and thus any impact with the soft wall will be generally in the same direction as the arrow. Several soft wall panels are shown mounted on the concrete barrier 26 wall in FIG. 1. The terms ▩concrete barrier wall▩ or ▩barrier wall▩ in this specification and in the following claims are intended to include any fixed longitudinally extending obstacle, such as walls and abutments of various heights and composition.

As generally shown in FIG. 2, a soft wall panel structure consists of two flat plastic panels 14, 18 laminated to the front and back of a core layer 10. High density polyethylene is the preferred material for the panels 14, 18. The core layer 10 is made of a flexible material, preferably one inch thick recycled rubber. The front panel 18 is preferably one inch thick and faces the road surface while rear panel 14 is preferably ⅜ of an inch thick and faces the barrier wall.

The materials used to construct the soft wall system were chosen because they are comparatively inexpensive, are capable of absorbing a large amount of kinetic energy by flexing but not fracturing, and are highly durable. The durability of these materials and structural arrangement of the components of the soft wall reduces or eliminates the creation of additional accident debris from the soft wall system. Excess debris lengthens accident clean up time and could injure spectators. The structure of the soft wall permits the wall to be repeatedly impacted while continuing to retain its functionality due to the strength and elasticity of high density polyethylene in combination with the resilient, air filled core layer 10 with its unique internal structure.

The front panel 18 is offset from the core layer 10 and rear panel 14 such that the front panel 18 forms an overhang 17 on one side of the panel structure 25 and exposes a portion of the core layer on the opposite side 20. When the panel structures 25 are attached to a concrete barrier wall the overhang 17 covers the exposed portion 20 of the core layer 10 of the adjacent panel. The exposed section 20 allows the extended portion 17 of the adjacent panel structure to lay flush with the next soft wall panel structure 25. The exposed vertical ends 21 and 19 of the front panel 18 are cut to alternating 45 degree angles. This angular design allows the front plastic panels of two adjacent panel structures to be more securely welded together. The ends are preferably ▩butt welded▩ using an electric heat fusion welder.

The core layer 10 has a hollow unitary structure including a front, rear, opposing sides, top and bottom. The core layer 10 is parallelogram shaped when viewed from above. The core layer 10 is hollow and is supported by six vertically extending partition walls 12 which partition the hollow core layer 10 into six vertically extending parallelogram shaped chambers 16 and one chamber that is triangular in shape. In FIG. 2 angle $\alpha$ is preferably 108 degrees. Angle $\beta$ in FIG. 2 is preferably 120 degrees. Angle $\alpha$ allows the individual panel structures 25 to securely interlock when attached to a concrete barrier wall. Angle $\beta$ as seen in FIG. 2 allows the chambers to more easily compress when impacted.

Figure 5:
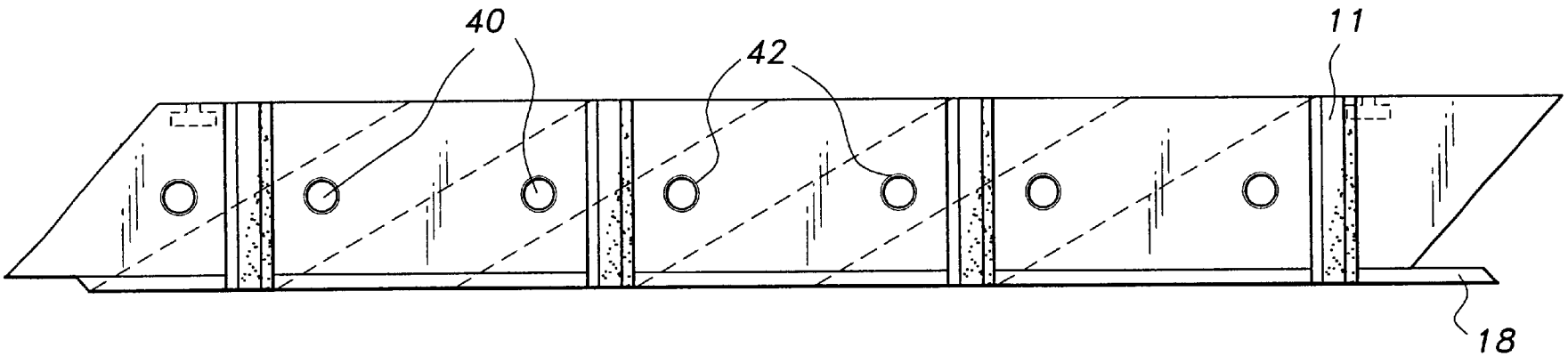
FIG. 5 is a bottom view of a soft wall panel structure showing the feet and the air escape apertures.

A vehicular impact compresses the panel structure 25 and collapses the internal chambers 16. This forces air out of the chambers 16 as they are compressed. Air can pass between chambers 16 through four ⅝ inch apertures 13 in each partition wall 12. Air can also escape through four ⅝ inch apertures 22 cut through each chamber 16 and extending through the front panel 18. Escaping air may also travel through a bottom aperture 40 in each chamber 16, as shown in FIG. 5, the aperture 40 being two inches in diameter and being reinforced by a metal ring 42 lining the aperture 40. The air is forced out the apertures because the chambers 16 are otherwise completely sealed. The top of each chamber 16 is sealed by a horizontally extending 3⁄16 of an inch thick rubber top piece 15 with a flat bottom and an arched top.

The preferred method of constructing the core layer 10 is to integrate at one time all the rubber components including the top 15 and the feet 11 into one mold so as to create a seamless construction by blow molding, injection molding, or other conventional processes for molding and shaping rubber products. Advantageously, the air chambers 16 with the restricted diameter orifices 13, 22 and 40 allow the air chambers to compress more slowly than open air tubes, thereby absorbing more of the energy from vehicular impact. The sloping partition walls 12 cause the core layer 10 to compress more readily than partition walls orthogonal to the front and rear of the core layer 10 in order to cushion the impact. Finally, the resilient nature of the core layer 10 causes the soft wall to return to its original configuration after the vehicle is removed from contact with the wall.

Figure 6:
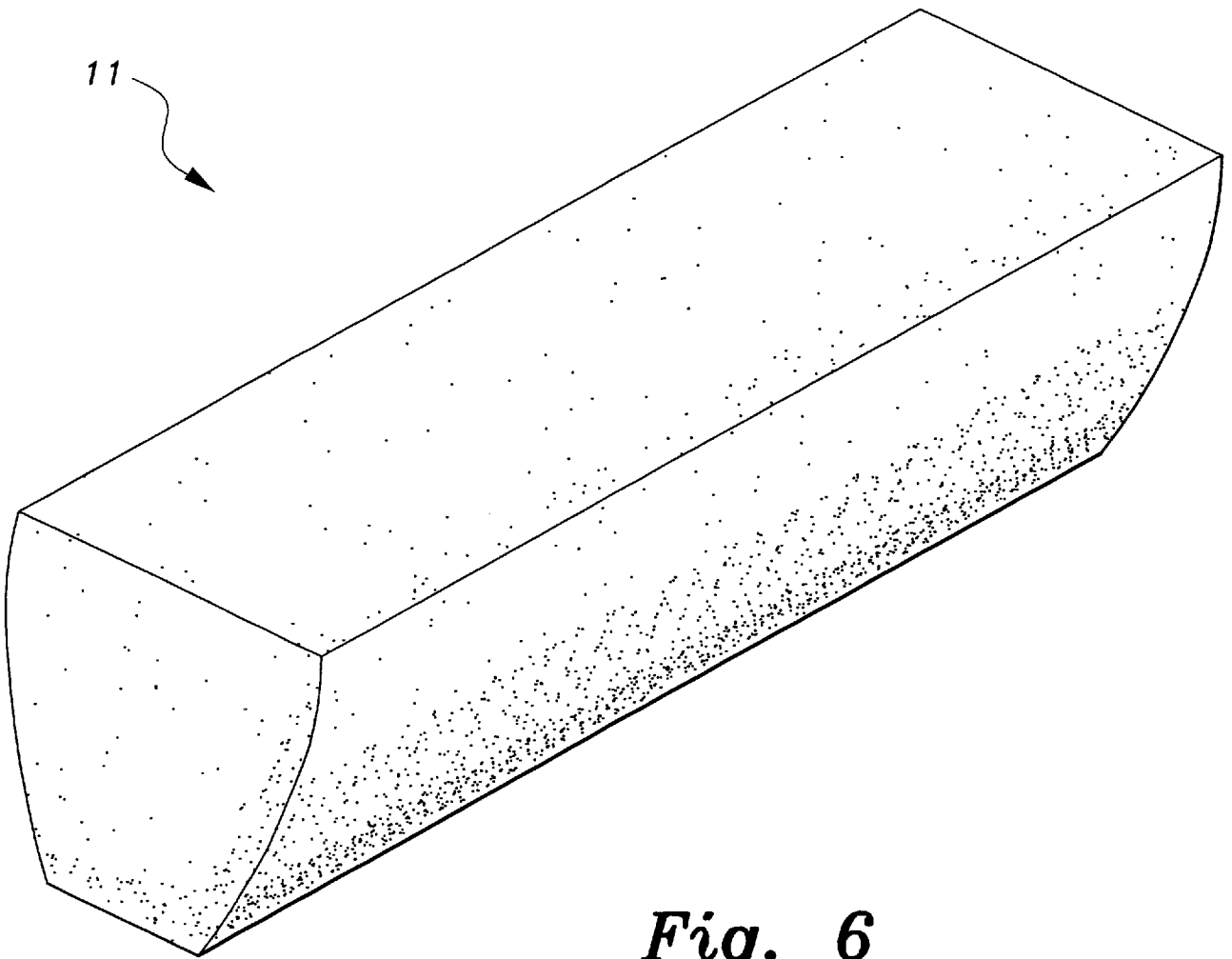
FIG. 6 is a perspective view of a rubber foot.

Turning to FIG. 5 four solid rubber protrusions or feet 11 can be seen to extend from the bottom of the core layer 10. As shown more particularly in FIG. 6, the feet 11 resemble an inverted triangle in shape, are three inches high and twelve inches long. The width of each foot 11 tapers in range from three inches wide where it contacts the core layer 10, to one inch wide where it contacts the track surface. The feet 11 as positioned serve several purposes, including allowing air to escape through the bottom aperture 40 during a vehicular impact, permitting a fork lift to easily lift and position each panel 25, and keeping each panel from trapping any water which could later seep out onto the race track during a race and become a hazard.

Figure 3A:
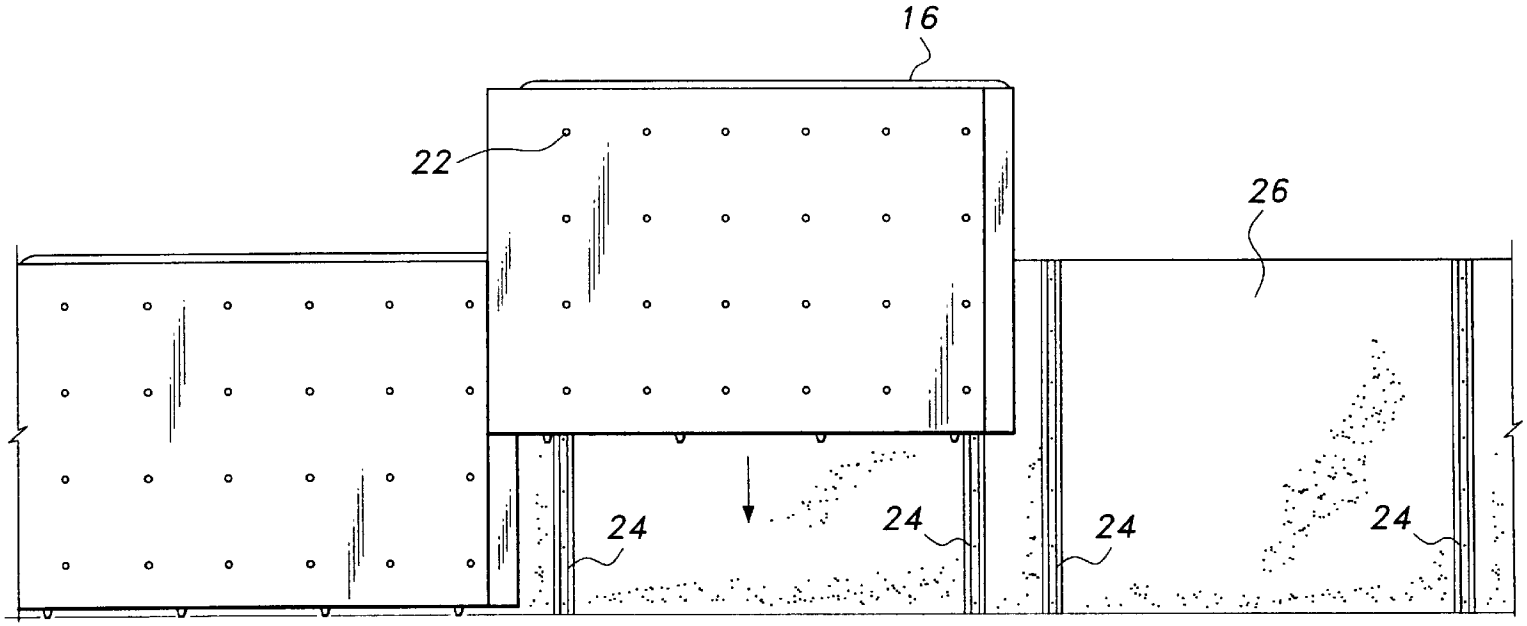
FIG. 3A is a front view of a panel structure that has been partially lowered into place.
Figure 3B:
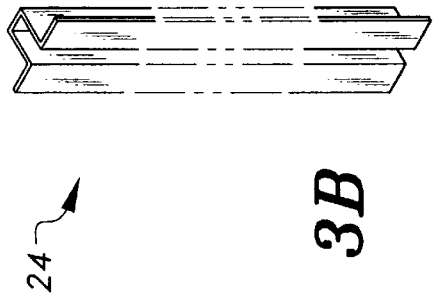
FIG. 3B is a perspective view of a bracket used to secure the soft wall to a barrier.
Figure 4:
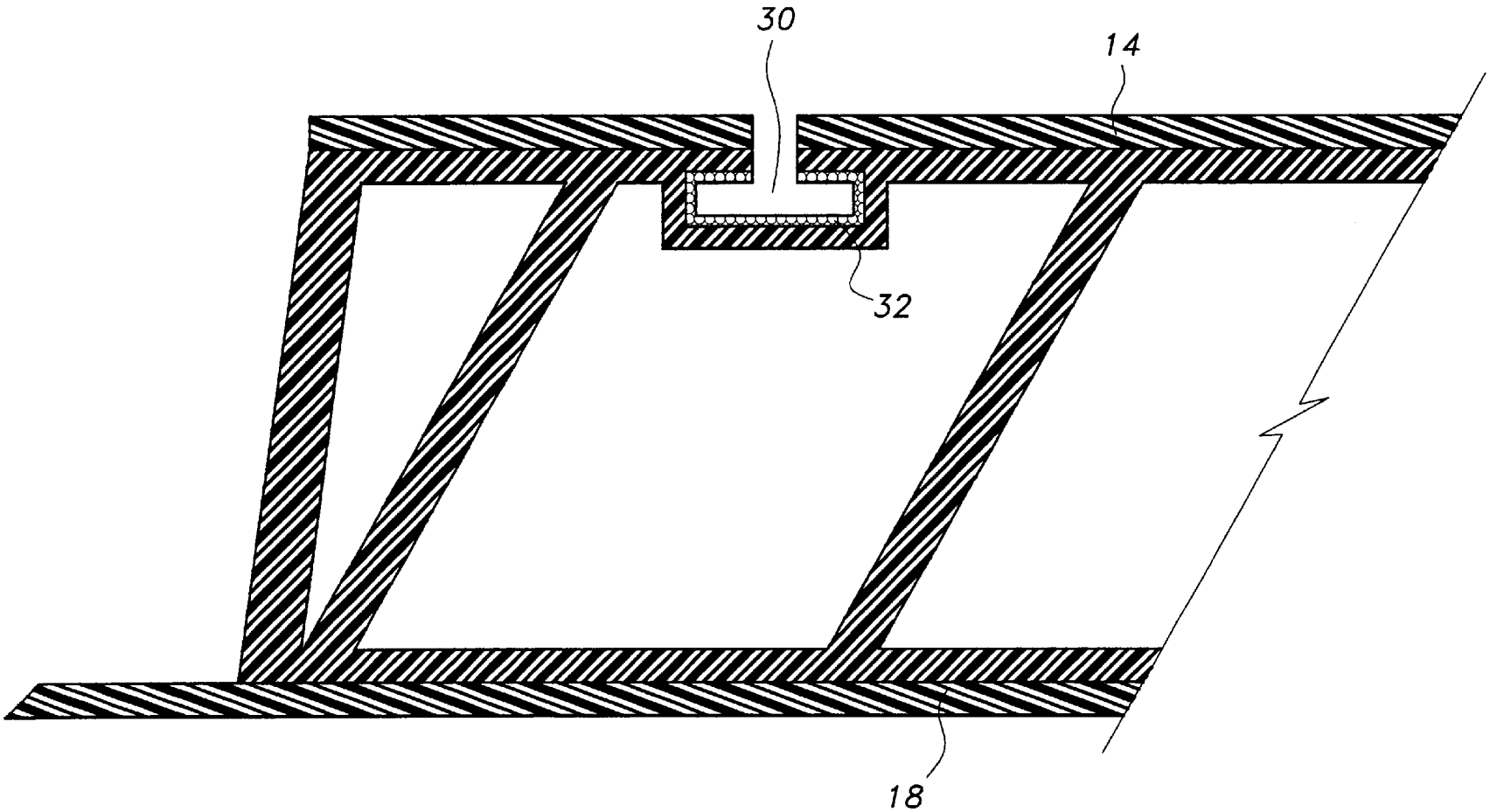
FIG. 4 is a fragmented horizontal cross section of a panel structure centered on the mounting groove.

FIG. 3A shows a panel structure 25 partially lowered into place. The soft wall is designed to be easily installed on a race track by lowering each panel structure 25 onto two wall anchors or brackets 24 (shown in greater detail in FIG. 3B) bolted to a concrete barrier wall 26. FIG. 4 shows a groove 30 defined in the core layer 10, so that the panel structure may be lowered with the groove 30 sliding onto the wall anchor 24 during installation. Each groove 30 is reinforced with steel belts 32 to insure that the panel is not torn from the barrier wall during a vehicular impact. The groove 30 may also be constructed of high density polyethylene or any other suitable material.

Figure 7:
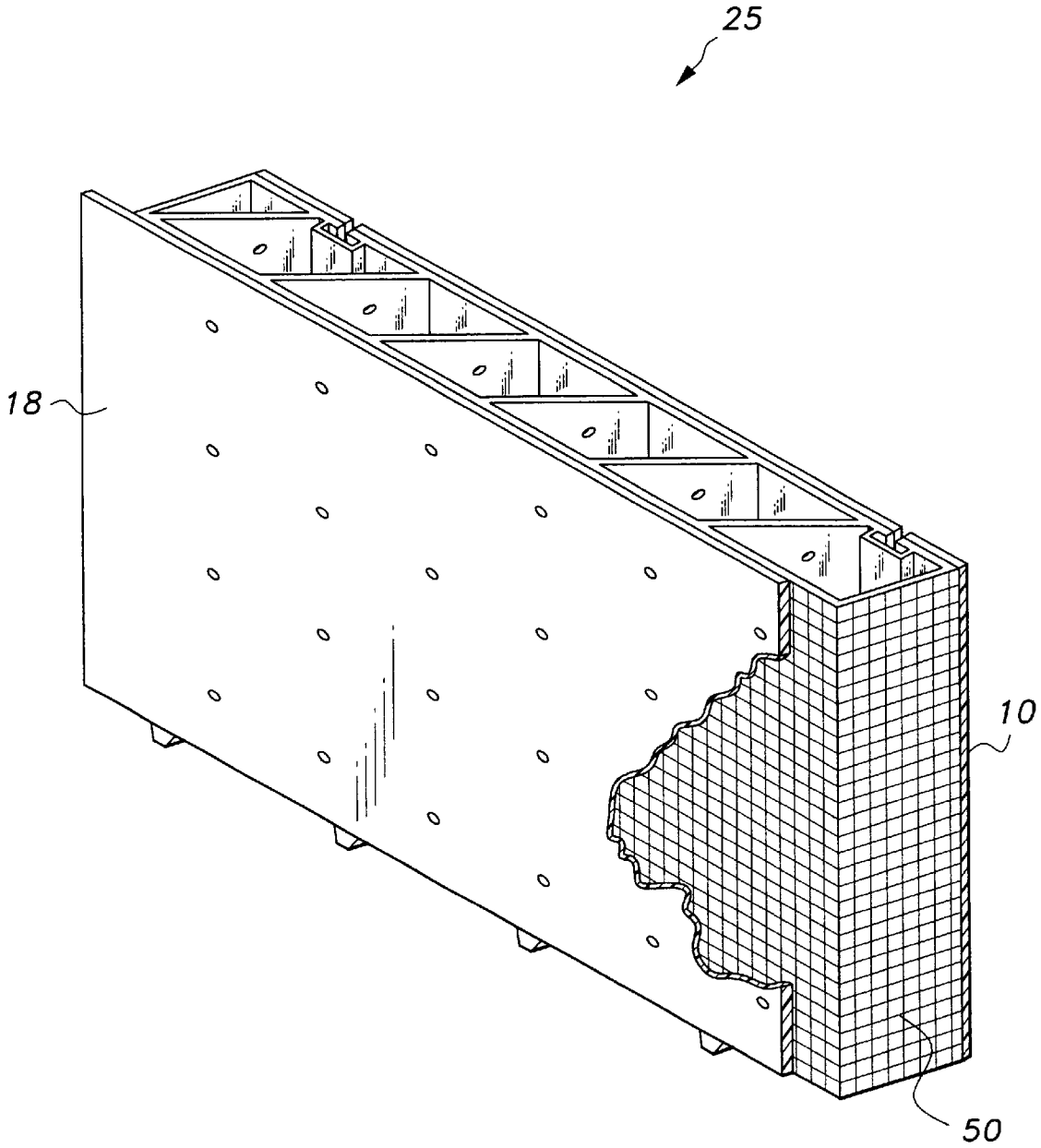
FIG. 7 is a perspective view of a soft wall panel with a portion of the inner panel and the core layer cut away to expose encapsulated cords made from synthetic fibers.

The core layer 10 may be made solely from solid rubber, or may have a reinforcing mesh of a conventional synthetic fiber cord embedded in the rubber, as shown in FIG. 7, which shows the soft wall with a portion of the inner panel 18 and the outer surface of the core layer 10 removed to expose encapsulated synthetic fiber cords 50 in the core layer 10. The synthetic fiber cords 50 are encapsulated in rubber and are preferably formed into a grid or mesh type pattern as shown and preferably extend throughout the core layer 10.

It will be understood that the recitation of dimensions in the foregoing description represents exemplary dimensions only for purposes of enablement, and are not intended for purposes of limitation. The thickness of the front and rear panels, the thickness of the walls of the core layer, the number of chambers defined by the core layer, the diameter of the openings of apertures by which air is vented to the atmosphere and between chambers, etc., are all manufacturing details. For example, the thickness of the front and rear panels and the walls of the core layer may be two inches, and the diameter of the apertures may be three inches in various embodiments of the present invention, consistent with the following claims.

It is to be understood that the present invention is not limited to the sole embodiment described above, but encompasses any and all embodiments within the scope of the following claims.

I claim:

1. A modular energy absorbing panel structure for cushioning a vehicular impact against a barrier, the panel structure comprising:

a flat elongated front panel, said front panel having an exterior face exposed to ambient atmosphere;

a flat elongated rear panel;

a hollow resilient core disposed between said front panel and said rear panel, the core having a front wall, a rear wall, opposing side walls, a top wall and a bottom wall, the core further having a plurality of vertically disposed partition walls defining a plurality of air chambers therein, said partition walls of each air chamber having a first plurality of apertures defined therein for fluid communication between adjacent air chambers; and a second plurality of apertures disposed through said front panel, said second plurality of apertures being in fluid communication with said air chambers and the atmosphere;

a third plurality of apertures disposed through said bottom wall, said third plurality of apertures being in fluid communication with said air chambers and the atmosphere;

wherein said front panel is laterally offset from the front wall of said core, whereby a portion of said front panel overhangs one of said opposing side walls of said core and a portion of the front wall of said core is exposed on the opposite side of said core;

wherein said partition walls are disposed at an oblique angle relative to the front wall and the rear wall of said core, whereby each said air chamber has a parallelogram shape in cross section; and wherein the rear wall of said core has at least one vertically disposed groove defined therein, the groove being adapted for sliding engagement with at least one bracket on the barrier.

2. The modular energy absorbing panel structure as in claim 1, further having:

a plurality of feet disposed upon the bottom of said core.

3. The modular energy absorbing system as in claim 1, further having:

a cord mesh disposed throughout said core.

4. The modular energy absorbing system as in claim 3, wherein:

said cord mesh is made from a synthetic fiber.

5. The modular energy absorbing panel structure as in claim 1, further comprising:

a plurality of steel belts;

wherein each of the atleast one groove being reinforced with said steel belts.

6. The modular energy absorbing panel structure as in claim 1, wherein said at least one groove is made from plastic.

7. The modular energy absorbing panel structure as in claim 1, wherein:

said front panel is made of high density polyethylene;

said core layer is made of rubber; and said rear panel is made of high density polyethylene.

* * * * *